US008220211B2

(12) United States Patent
Dolby et al.

(10) Patent No.: US 8,220,211 B2
(45) Date of Patent: Jul. 17, 2012

(54) TOGGLE ASSEMBLY FOR RETAINING A PANEL MEMBER

(75) Inventors: Jeffrey Scott Dolby, Buford, GA (US); Gregory Blake McKenna, Cumming, GA (US)

(73) Assignee: Alcoa Inc., Pittsburgh, PA (US)

( * ) Notice: Subject to any disclaimer, the term of this patent is extended or adjusted under 35 U.S.C. 154(b) by 264 days.

(21) Appl. No.: 12/793,917

(22) Filed: Jun. 4, 2010

(65) Prior Publication Data

US 2011/0296775 A1 Dec. 8, 2011

(51) Int. Cl.
*E06B 3/964* (2006.01)

(52) U.S. Cl. ..... 52/204.62; 52/204.64; 52/204.66; 411/85

(58) Field of Classification Search ..... 52/204.62, 52/204.64, 204.66, 235, 704, 705, 710; 411/84, 411/85, 340

See application file for complete search history.

(56) References Cited

U.S. PATENT DOCUMENTS 5,553,422 A * 9/1996 Gazaway ..... 52/204.53
2008/0080948 A1 * 4/2008 Barclay De Tolly et al. . 411/340

* cited by examiner

*Primary Examiner* — William Gilbert
*Assistant Examiner* — Patrick Maestri
(74) *Attorney, Agent, or Firm* — Greenberg Traurig, LLP

(57) ABSTRACT

The present invention relates to a toggle assembly that can be used with a curtain wall system to retain infills of panel members. A toggle assembly of the present invention is sufficiently designed to simultaneously retain in place a first infill of a first panel member and a first infill of a second panel member on both sides of a mullion, wherein at least a portion of the toggle assembly directly engages at least a portion of the first infill of the first panel member and at least a portion of the first infill of the second panel member.

14 Claims, 10 Drawing Sheets

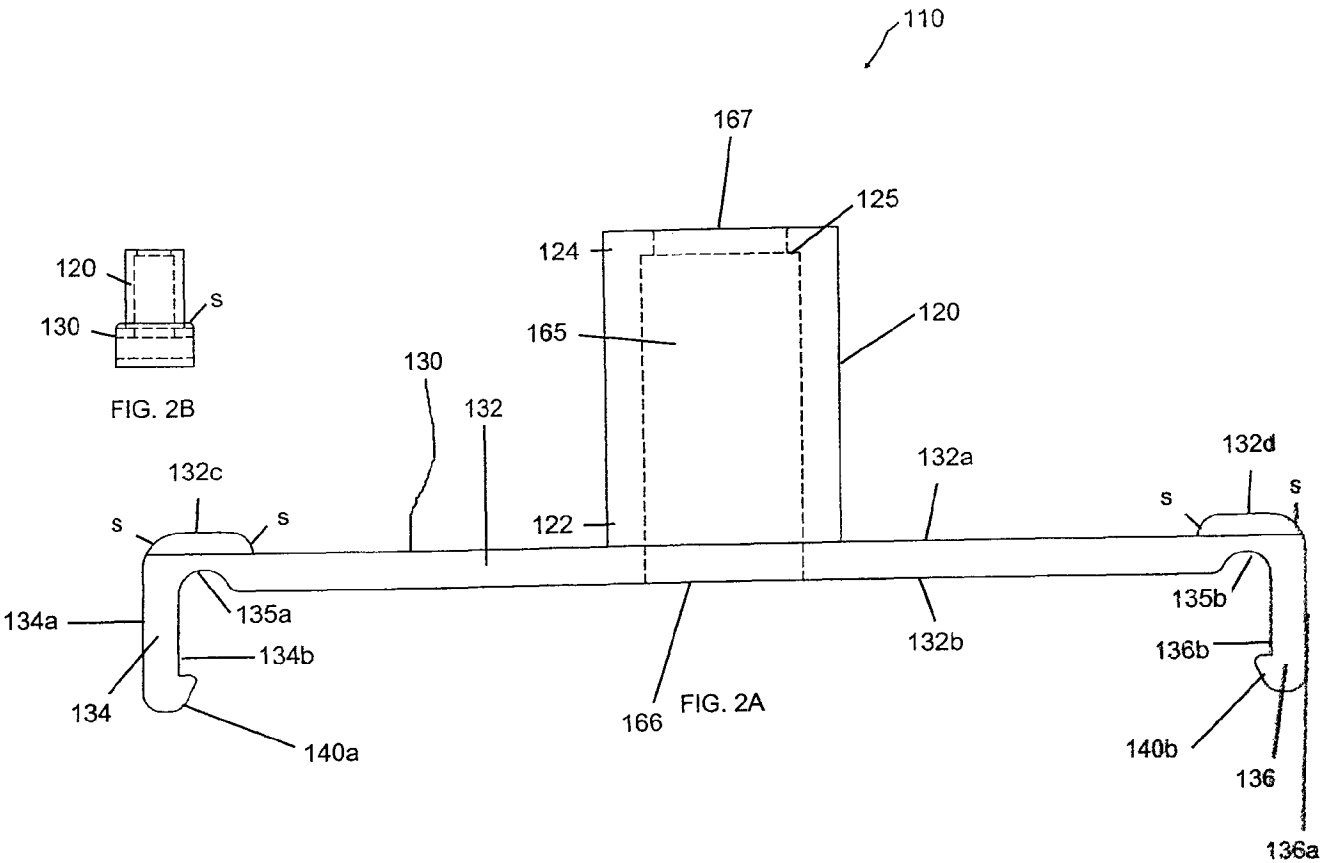
FIG. 2A
FIG. 2B
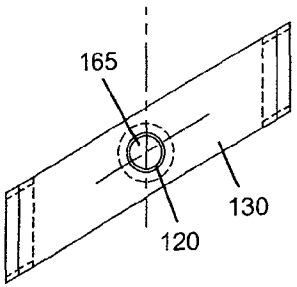
FIG. 2C

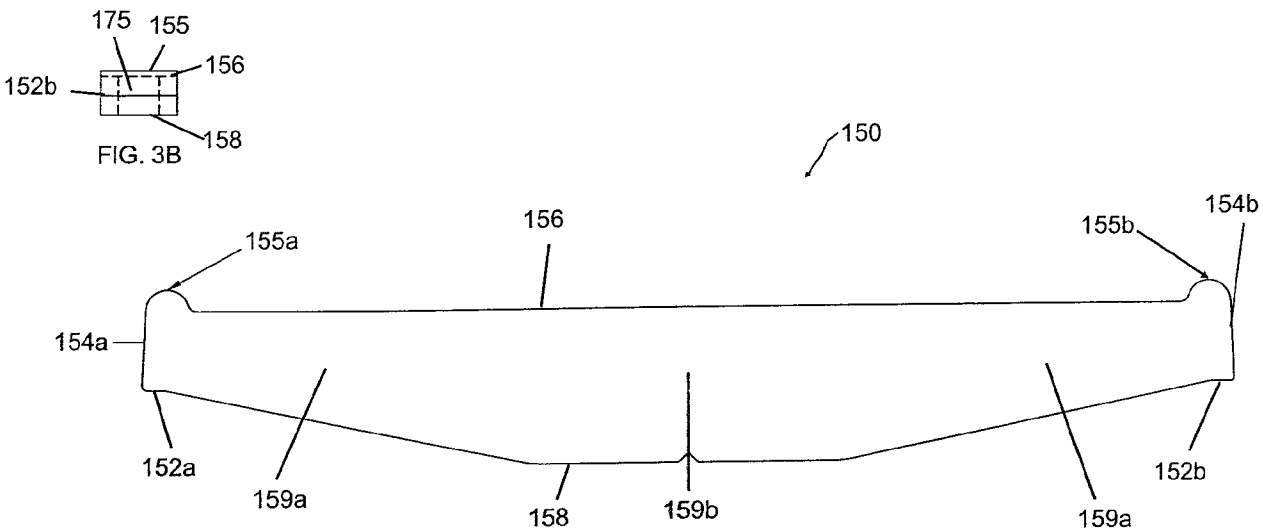
FIG. 3A
FIG. 3B
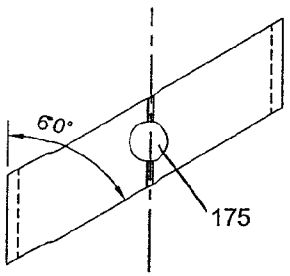
FIG. 3C

TOGGLE ASSEMBLY FOR RETAINING A PANEL MEMBER

BACKGROUND

In building structures, it is often aesthetically desirable to cover large portions of the outside of the structures with as much glass and as little outside framing elements as possible, thereby providing the structures with a smooth and unbroken outside surface appearance. Conventionally, a structural adhesive bond is provided between the building structure and the inside surfaces of glass panels to attach the panels to the building structure, thus reducing or eliminating the need for permanent outside retention members. Such bonding configurations are commonly known as "Structural Silicone Glazing" or "SSG" systems.

Typical SSG systems fall into two major classes: two-sided and four-sided. Four-sided SSG systems typically include a plurality of vertical structural mullions in combination with a plurality of horizontal structural mullions, which combine to form a mullion framework having a plurality of panel-shaped openings which are slightly smaller than the glass panels to be supported. The mullion framework is fixed about the exterior of a building structure. Each glass panel is positioned adjacent to the exterior surface of the mullion framework and over a corresponding panel-shaped opening by a plurality of retaining clips, such that the edges of the panel slightly overlap the panel-shaped opening and a small gap exists between the inside surfaces of the glass panel and the framework. Structural adhesive, typically structural silicone, is then applied into the gap. After the silicone adhesive cures, it provides a structural bond between the mullion framework and the glass panel which can support the glass panel for lateral loads. For weatherproofing purposes, additional silicone adhesive is then applied from the outside of the building into gaps created by the abutting edges of the adjacent glass panels.

Two-sided SSG systems differ in that a structural adhesive bond as described above is provided along two (usually vertical) opposing edges of the glass panels. In two-sided SSG systems, the two edges not being structurally bonded to the mullion framework are retained by other means, typically mechanically fastened, and thus support the dead load of the panels. This is normally done by conventional window glazing means which enclose the entire edge of the glass panels, thus not providing the smooth continuous appearance of four-sided SSG systems.

SUMMARY

According to aspects illustrated herein, in an embodiment there is disclosed a toggle assembly that includes a toggle component comprising a clip and a spacer, wherein the clip comprises a base, a left face, and a right face, wherein the base has an upper surface engaging the spacer and a lower surface, wherein the left face comprises an outer surface and an inner surface, wherein the right face comprises an outer surface and an inner surface, wherein a left-side track forms at a junction between the lower surface of the base and the inner surface of the left face, wherein a right-side track forms at a junction between the lower surface of the base and the inner surface of the right face, wherein the left face terminates in a left engagement leg, wherein the right face terminates in a right engagement leg, and wherein the spacer is substantially shaped as a hollow cylinder having a first end engaging the upper surface of the base and a second end, wherein the spacer has a first internal radius at the first end that is larger than a second internal radius at the second end, and wherein an internal circular ridge is created at a junction between the first internal radius and the second internal radius; and a support reinforcement bar, wherein the support reinforcement bar is sized and dimensioned to fit within a space created between the lower surface of the base, the inner surface of the left face, and the inner surface of the right face, wherein the support reinforcement bar comprises a left lip that engages with the left-side track of the toggle component and a right lip that engages with the right-side track of the toggle component, and wherein the engagement leg of the left face and the engagement leg of the right face are sufficiently designed to maintain the support reinforcement bar within the clip of the toggle component.

According to aspects illustrated herein, in an embodiment there is disclosed a toggle glazed curtain wall system comprising at least one toggle assembly of the present invention.

According to aspects illustrated herein, in an embodiment there is disclosed a pair of insulating glass units for a building that includes a first insulating glass unit; a second insulating glass unit; a first toggle assembly; and a second toggle assembly, wherein the first insulating glass unit includes a first glass lite and a second glass lite attached to a structural separator spacer with a structural adhesive sealant having an edge with a continuous recess, wherein the second insulating glass unit includes a first glass lite and a second glass lite attached to a structural separator spacer with a structural adhesive sealant having an edge with a continuous recess, wherein at least a portion of the first toggle assembly is configured to be simultaneously positioned anywhere within the continuous recess of the separator spacer of the first insulating glass unit and the continuous recess of the separator spacer of the second insulating glass unit, wherein at least a portion of the first toggle assembly is sufficiently designed to be in direct contact with the first glass lite of the first insulating glass unit and the first glass lite of the second insulating glass unit, wherein at least a portion of the second toggle assembly is configured to be simultaneously positioned anywhere within the continuous recess of the separator spacer of the first insulating glass unit and the continuous recess of the separator spacer of the second insulating glass unit, wherein at least a portion of the second toggle assembly is sufficiently designed to be in direct contact with the first glass lite of the first insulating glass unit and the first glass lite of the second insulating glass unit, wherein the first toggle assembly is sufficiently designed to simultaneously retain in place the first glass lite of the first insulating glass unit and the first glass lite of the second insulating glass unit on both sides of a mullion, and wherein the second toggle assembly is sufficiently designed to simultaneously retain in place the first glass lite of the first insulating glass unit and the first glass lite of the second insulating glass unit on both sides of a mullion.

According to aspects illustrated herein, in an embodiment there is disclosed a glazing assembly for a building that includes a first insulating glass unit engaged with a first interface channel by at least one of a structural silicone or a structural glazing tape, wherein the first insulating glass unit includes a first glass lite and a second glass lite mounted parallel to and spaced from the first glass lite by a separator spacer, wherein the first interface channel includes an edge with a continuous recess; a second insulating glass unit engaged with a second interface channel by at least one of a structural silicone or a structural glazing tape, wherein the second insulating glass unit includes a first glass lite and a second glass lite mounted parallel to and spaced from the first glass lite by a separator spacer, wherein the second interface channel includes an edge with a continuous recess; a first toggle assembly; and a second toggle assembly, wherein at least a portion of the first toggle assembly is configured to be simultaneously positioned anywhere within the continuous recess of the interface channel of the first insulating glass unit and the continuous recess of the interface channel of the second insulating glass unit, wherein at least a portion of the first toggle assembly is sufficiently designed to be in direct contact with the interface channel of the first insulating glass unit and the interface channel of the second insulating glass unit, wherein at least a portion of the second toggle assembly is configured to be simultaneously positioned anywhere within the continuous recess of the interface channel of the first insulating glass unit and the continuous recess of the interface channel of the second insulating glass unit, wherein at least a portion of the first toggle assembly is sufficiently designed to be in direct contact with the interface channel of the first insulating glass unit and the interface channel of the second insulating glass unit, wherein the first toggle assembly is sufficiently designed to simultaneously retain in place the first glass lite of the first insulating glass unit and the first glass lite of the second insulating glass unit on both sides of a mullion, and wherein the second toggle assembly is sufficiently designed to simultaneously retain in place the first glass lite of the first insulating glass unit and the first glass lite of the second insulating glass unit on both sides of a mullion.

According to aspects illustrated herein, in an embodiment there is disclosed a method of installing a toggle assembly of the present invention, the toggle assembly being sufficiently designed to retain or fix the glass lites of an insulating glass unit in place on both sides of a mullion (i.e., support two glass lites simultaneously) reducing the number of toggle assemblies required for a given application as compared to conventional retaining components.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

As illustrated in FIG. 1, a fastener is positioned between the toggle component and the support reinforcement bar;

FIGS. 2A, 2B and 2C illustrate various views of the toggle component of the toggle assembly of FIG. 1. FIG. 2A shows a top orthographic view of the toggle component, FIG. 2B shows a side orthographic view of the toggle component, and FIG. 2C shows a front orthographic view of the toggle component;

FIGS. 3A, 3B and 3C illustrate various views of the support reinforcement bar of the toggle assembly of FIG. 1. FIG. 3A shows a top orthographic view of the support reinforcement bar, FIG. 3B shows a side orthographic view of the support reinforcement bar, and FIG. 3C shows a front orthographic view of the support reinforcement bar;

FIG. 4A shows a top view of a toggle assembly at a starting position at a vertical mullion (top left insert), a front view of the toggle assembly at the starting position at the vertical mullion (bottom left insert), a top view of the toggle assembly at a finished position at the vertical mullion (top right insert), and a front view of the toggle assembly at the finished position at the vertical mullion (bottom right insert). FIG. 4B shows a top view of a toggle assembly at a starting position at a horizontal transom (top left insert), a front view of the toggle assembly at a starting position at the horizontal transom (bottom left insert), a top view of the toggle assembly at a finished position at the horizontal transom (top right insert), and a front view of the toggle assembly at the finished position at the horizontal transom (bottom right insert).

Figure 1:
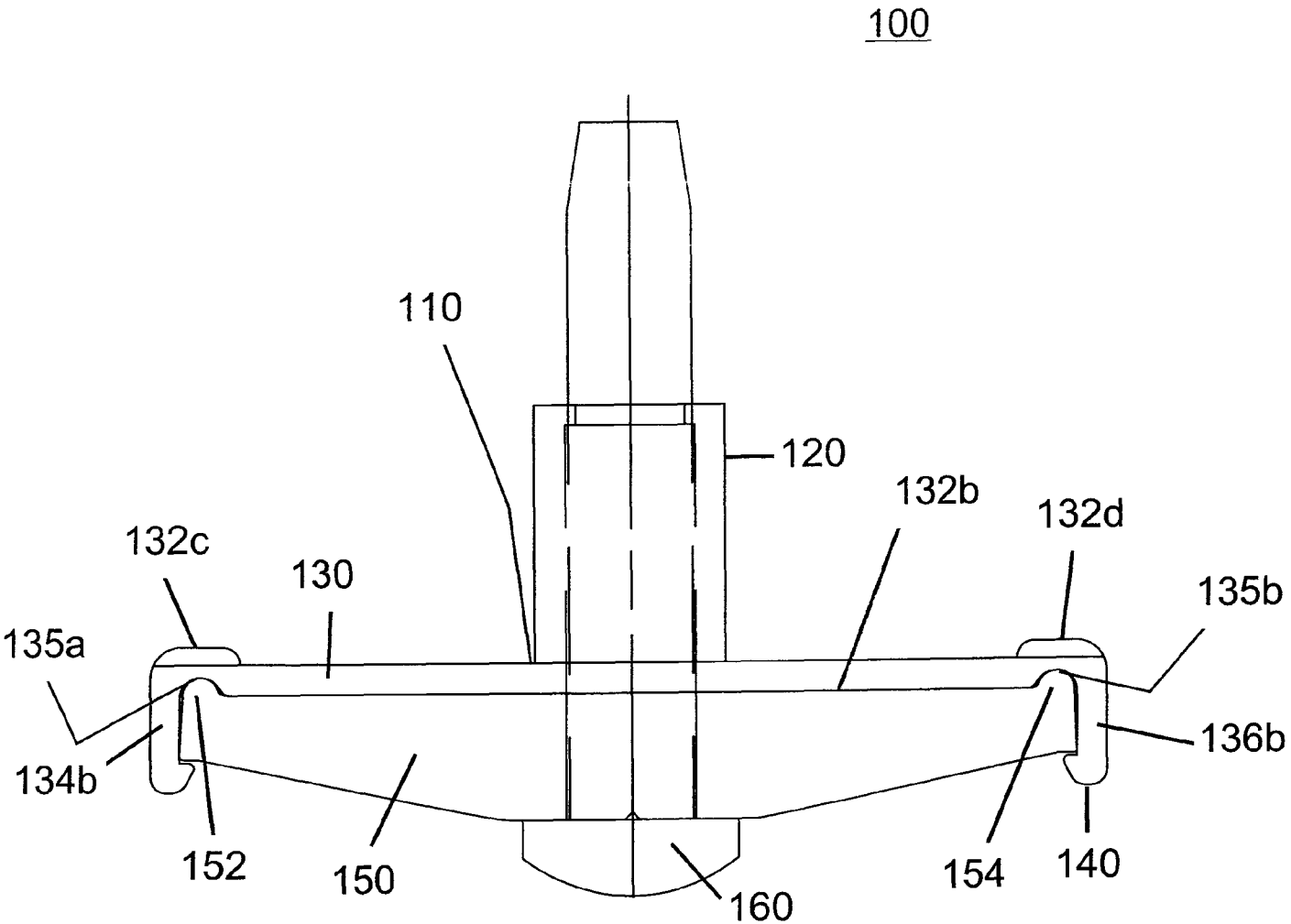
FIG. 1 shows a top view of an embodiment of a toggle assembly of the present invention. The toggle assembly includes a toggle component having a toggle base and a toggle spacer; and a support reinforcement bar.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the present invention.

DETAILED DESCRIPTION

As used herein, the terms "insulated glass", "double glazing", "Double Glazed Units", "Insulating Glass Unit" or "IGU" are used herein to refer to glass panes or "lites" that are assembled into units. The IGU includes a first glass lite and a second glass lite mounted parallel to and spaced from the first glass lite by a separator spacer.

As used herein, the term "mullion" refers to either a vertical mullion or a horizontal mullion (sometimes called "transom") of a toggle glazed curtain wall system of the present invention. A typical toggle glazed curtain wall system includes a mullion structure in which mullions are fixed to a structural body of building, for example, such as concrete floor slab, steel framed truss or the like, transoms are stretched between adjacent mullions respectively, and panel members are mounted to a space defined by the adjacent two mullions and the transoms stretched therebetween.

As used herein, the term "screw spline toggle glazed curtain wall system" refers to an embodiment of a mullion structure or framing assembly application of the present invention.

As used herein, the term "screw spline interface toggle glazed curtain wall system" refers to an embodiment of a mullion structure or framing assembly application of the present invention with an applied interface and structural silicone.

As used herein, the term "screw spline interface tape toggle glazed curtain wall system" refers to an embodiment of a mullion structure or framing assembly application of the present invention with an applied interface and structural glazing tape.

While illustrative embodiments of the present invention described herein show toggle glazed curtain wall systems that include panel members with glass pane infills, it should be understood that a toggle assembly of the present invention can be used in other applications where the panel members include other infills made up of nearly any exterior building element, including, but not limited to, fabric, metals (such as aluminum, stainless steel, and composite metals), composite materials (such as fiber-reinforced plastic), ceramics (such as travertine), and stones (such as calcium silicate, granite, marble, slate, travertine, limestone and concrete). A toggle assembly of the present invention is sufficiently designed to simultaneously retain in place a first panel infill of a first panel member and a first panel infill of a second panel member on both sides of a mullion, wherein at least a portion of the toggle assembly directly engages at least a portion of the first panel infill of the first panel member and at least a portion of the first panel infill of the second panel member.

FIG. 1 shows a top view of an embodiment of a toggle assembly 100 of the present invention. In an embodiment, a glazing assembly for a building includes at least one toggle assembly 100 of the present invention. In an embodiment, a curtain wall glazing system includes at least one toggle assembly 100 of the present invention. The toggle assembly 100 includes a toggle component 110 removably engaged with a support reinforcement bar 150 using a fastener 160. As further illustrated in FIG. 2A and FIG. 2B, the toggle component 110 comprises a clip 130 and a spacer 120. In an embodiment, the clip 130 and the spacer 120 are manufactured as a single unit. In an embodiment, the clip 130 and the spacer 120 are manufactured from a polymer material, such as a homopolymer or a copolymer. In an embodiment, the polymer is a polyamide copolymer. In an embodiment, the polymer is a copolymer derived from acrylonitrile, butadiene, and styrene, for example, acrylonitrile butadiene styrene (ABS). In an embodiment, the polymer is a polyvinyl chloride homopolymer. In an embodiment, the clip 130 and the spacer 120 are manufactured from a polymer material allowing the toggle component 110 to directly come in contact with the glass of an IGU, while also acting as an insulator against heat flow through a curtain wall glazing system. As illustrated in FIG. 2C, the clip 130 comprises a base 132, a left face 134, and a right face 136. The base 132 has an upper surface 132*a* that engages the spacer 120 and a lower surface 132*b*. The upper surface 132*a* of the base 132 has a left end terminating in a left raised portion 132*c* and a right end terminating in a right raised portion 132*d*. The left raised portion 132*c* and the right raised portion 132*d* have smooth corners "s" that are radiused to help maneuver the toggle component 110 in position during use. In an embodiment, the left raised portion 132*c* and the right raised portion 132*d* are intermittent on the upper surface 132*a* of the base 132, that is the left raised portion 132*c* and the right raised portion 132*d* are not continuous along the entire upper surface 132*a* of the base 132. The left face 134 descends from the left raised portion 132*c* of the base 132, and comprises an outer surface 134*a* and an inner surface 134*b*. The right face 136 descends from the right raised portion 132*d* of the base 132, and comprises an outer surface 136*a* and an inner surface 136*b*. The descent of the left face 134 forms a left-side track 135*a* at a junction between the lower surface 132*b* of the base 132 and the inner surface 134*b* of the left face 134. The descent of the right face 136 forms a right-side track 135*b* at a junction between the lower surface of the base 132*b* and the inner surface of the right face 136*b*. The left face 134 terminates in a left engagement leg 140*a* and the right face 136 terminates in a right engagement leg 140*b*. The spacer 120 has a first end 122 engaging the upper surface 132*a* of the base 132 and a second end 124 comprising a circular ridge 125.

FIGS. 3A, 3B and 3C show the support reinforcing bar 150 of the toggle assembly 100. The support reinforcement bar 150 is sized and dimensioned to fit within a space created between the lower surface of the base 132*b*, the inner surface of the left face 134*b*, and the inner surface of the right face 136*b* of the clip 130, as illustrated in FIG. 1. The support reinforcement bar 150 comprises a left lip 155*a* that engages with the left-side track 135*a* of the clip 130 and a right lip 155*b* that engages with the right-side track 135*b* of the clip 130. The support reinforcement bar 150 comprises a left edge 152*a* that engages with the left engagement leg 140*a* of the left face 134 and a right edge 152*b* that engages with the right engagement leg 140*b* of the right face 136. The left-side track 135*a* and the right-side track 135*b* of the clip 130 keeps the support reinforcement bar 150 from rotating, while the left engagement leg 140*a* and the right engagement leg 140*b* of the clip 130 keeps the support reinforcement bar 150 from pulling up. When the fastener 160 is positioned in the toggle assembly 100, the support reinforcement bar 150 is fixed to the clip 130, substantially preventing movement of the support reinforcement bar 150. The support reinforcement bar 150 has a left end 154*a* which, when positioned within the space of the clip 130, engages the inner surface 134*b* of the clip 130. The support reinforcement bar 150 has a right end 154*b* which, when positioned within the space of the clip 130, engages the inner surface 136*b* of the clip 130. The support reinforcement bar 150 has a back face 156 which, when positioned within the space of the clip 130, engages the lower surface 132*b* of the clip 130, and the support reinforcement bar 150 has a front face 158. The support reinforcement bar 150 is thinner at ends 159*a* as compared to center portion 159*b*. During installation of a toggle assembly 100, the thinner ends 159*a* of the support reinforcement bar 150 allow additional clearance at spaces between the two panel infills of a panel member to help maneuver the toggle assembly 100 into position, while the thicker center portion 159*b* increases the bending stress that the toggle assembly 100 can handle.

The support reinforcement bar 150 also includes a complementary receiving hole 175 configured to receive the fastener 160.

In an embodiment, the support reinforcing bar 150 is manufactured from a corrosion-resistant material selected from the group consisting of metals, ceramics and polymers. In an embodiment, the support reinforcing bar 150 is manufactured from a material that is conventionally considered corrosive and subsequently coated with a corrosion-resistant material to impart resistance to corrosion. In an embodiment, the support reinforcing bar 150 is manufactured from a corrosion-resistant aluminum alloy. In an embodiment, the support reinforcing bar 150 is manufactured from a corrosion-resistant stainless steel. In an embodiment, the support reinforcing bar 150 is manufactured from a corrosion-resistant ceramic. In an embodiment, the support reinforcing bar 150 is manufactured from a corrosion-resistant polymer.

As illustrated in FIG. 2C and FIG. 3C, the clip 130 and the support reinforcement bar 150, respectively, are generally shaped like a quadrilateral. As used herein, the term "quadrilateral" refers to any 4-sided polygon with at least one pair of parallel sides. In an embodiment, the clip 130 and the support reinforcement bar 150 are shaped like parallelograms, where opposite sides are parallel and equal in length, and opposite angles are equal. In an embodiment, the clip 130 is shaped like a parallelogram having two angles of approximately 60° and two angles of approximately 120°. In an embodiment, the support reinforcement bar 150 is shaped like a parallelogram having two angles of approximately 60° and two angles of approximately 120°. The toggle component 110 includes a receiving hole 165 configured to receive a fastener 160. The receiving hole 165 comprises an entry end 166 at the lower surface 132*b* of the base 132 and an exit end 167 at the second end 124 of the spacer 120. The internal diameter of the entry end 166 of the receiving hole 165 is larger than the internal diameter of the exit end 167 of the receiving hole 165. In an embodiment, the internal diameter of the entry end 166 of the receiving hole 165 is between about 0.250 inches and about 0.260 inches. In an embodiment, the internal diameter of the exit end 167 of the receiving hole 165 is between about 0.210 inches and about 0.220 inches. The internal diameter of the exit end 167 of the receiving hole 165 is sized so that, when a fastener 160 is positioned through the receiving holes 175 and 165, and the fastener 160 is turned, threads of the fastener 160 grab the circular ridge 125 and rotate the toggle assembly 100 into position, as further illustrated in FIG. 4A, FIG. 4B and FIG. 5. The internal diameter of the receiving hole 175 is substantially the same as the internal diameter of the entry end 166 of the receiving hole 165. In an embodiment, the internal diameter of the receiving hole 175 is between about 0.250 inches and about 0.260 inches.

Figure 4A:
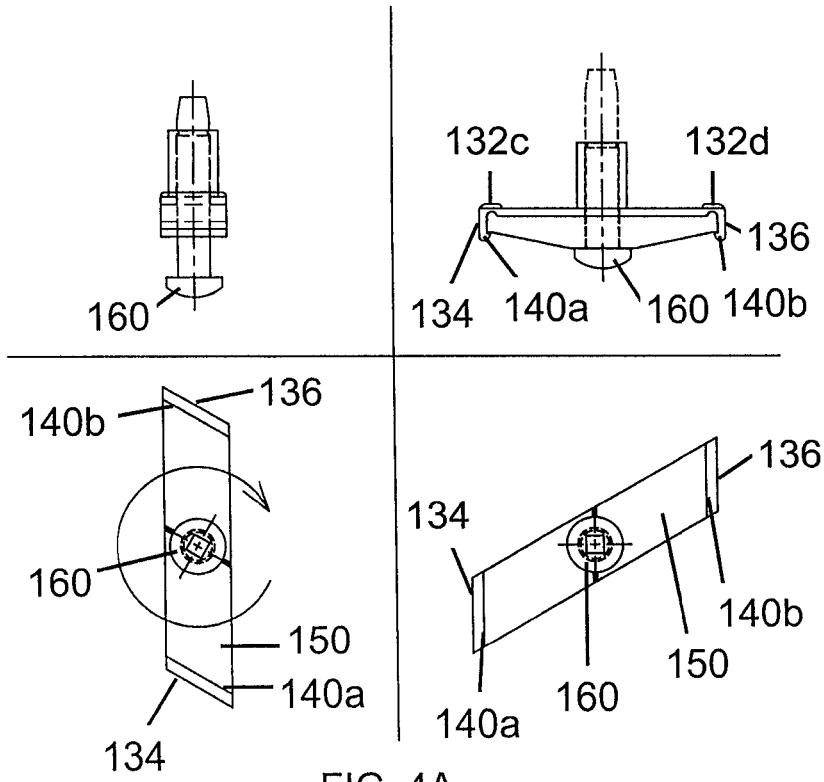
FIGS. 4A and 4B illustrate various views of an embodiment of an installation process for installing at least one toggle assembly of the present invention at various positions at a toggle glazed curtain wall system of the present invention that includes vertical mullions and horizontal transoms (the components of the curtain wall are not shown in the various views).
Figure 4B:
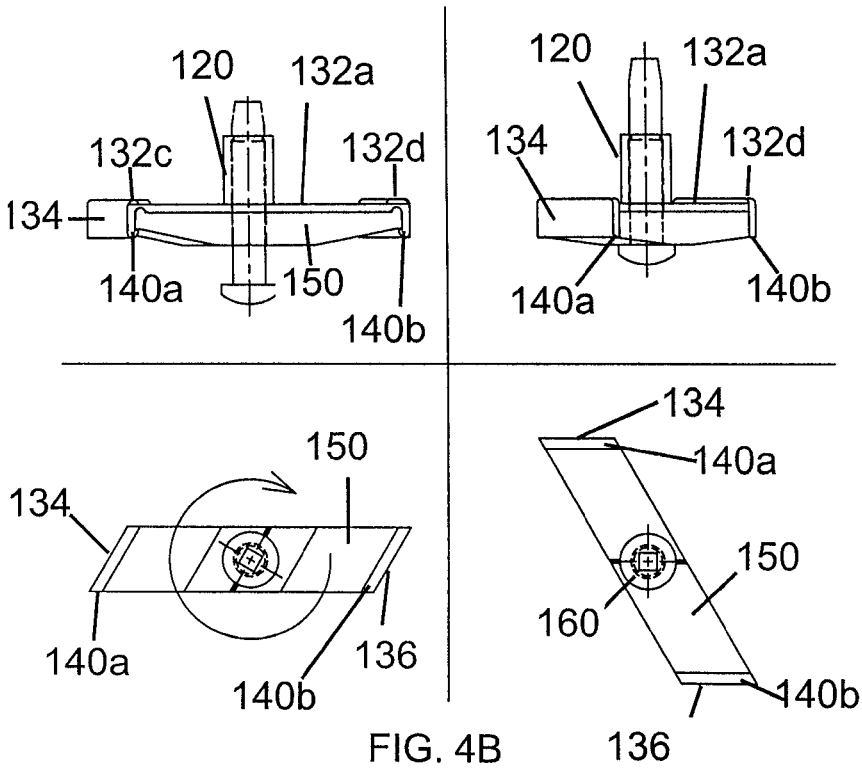

FIGS. 4A and 4B illustrate various views of an embodiment of an installation process for installing at least one toggle assembly 100 of the present invention at various positions at a toggle glazed curtain wall system that includes vertical mullions and horizontal transoms (the components of the curtain wall are not illustrated). In an embodiment, a toggle glazed curtain wall system of the present invention is a type of Structural Silicone Glazing or SSG system. In an embodiment, the toggle glazed curtain wall system is a screw spline toggle glazed curtain wall system. In an embodiment, the toggle glazed curtain wall system is a screw spline interface toggle glazed curtain wall system. In an embodiment, the toggle glazed curtain wall system is a screw spline interface tape toggle glazed curtain wall system. FIG. 4A shows a top view of a toggle assembly 100 at a starting position at a vertical mullion (top left insert), a front view of the toggle assembly 100 at the starting position at the vertical mullion (bottom left insert), a top view of the toggle assembly 100 at a finished position at the vertical mullion (top right insert), and a front view of the toggle assembly 100 at the finished position at the vertical mullion (bottom right insert). FIG. 4B shows a top view of the toggle assembly 100 at a starting position at a horizontal transom (top left insert), a front view of the toggle assembly 100 at a starting position at the horizontal transom (bottom left insert), a top view of the toggle assembly 100 at a finished position at the horizontal transom (top right insert), and a front view of the toggle assembly 100 at the finished position at the horizontal transom (bottom right insert).

As illustrated in FIG. 4A and FIG. 4B, the toggle assembly 100 is sufficiently designed so that when the fastener 160 is positioned through the receiving holes 175 and 165, and turned, threads of the fastener 160 engage the circular ridge 125 of the spacer 120 of the toggle component 110 and begin to rotate the toggle assembly 100 into position. Thus, the toggle assembly 100 of the present invention is sufficiently designed for automatic rotation. Once the toggle assembly 100 is rotated into position, the toggle assembly 100 is configured to retain or fix the glass lites of an insulating glass unit (IGU) in place on both sides of the mullion (i.e., support two glass lites simultaneously). Since the toggle assembly 100 is configured to retain the glass lites on both sides of the mullion, the number of toggle assemblies required for a given application may be reduced as compared to conventional retaining components which typically support only one glass lite at a time. In an embodiment, the spacer 120 of the toggle assembly 100 is sufficiently designed to allow the assembly 100 to be installed without excessive point loading on the IGU while applying proper compression on the interior gaskets positioned between a mullion and the IGU, which may contribute to the ease of the glass installation procedure.

Figure 5A:
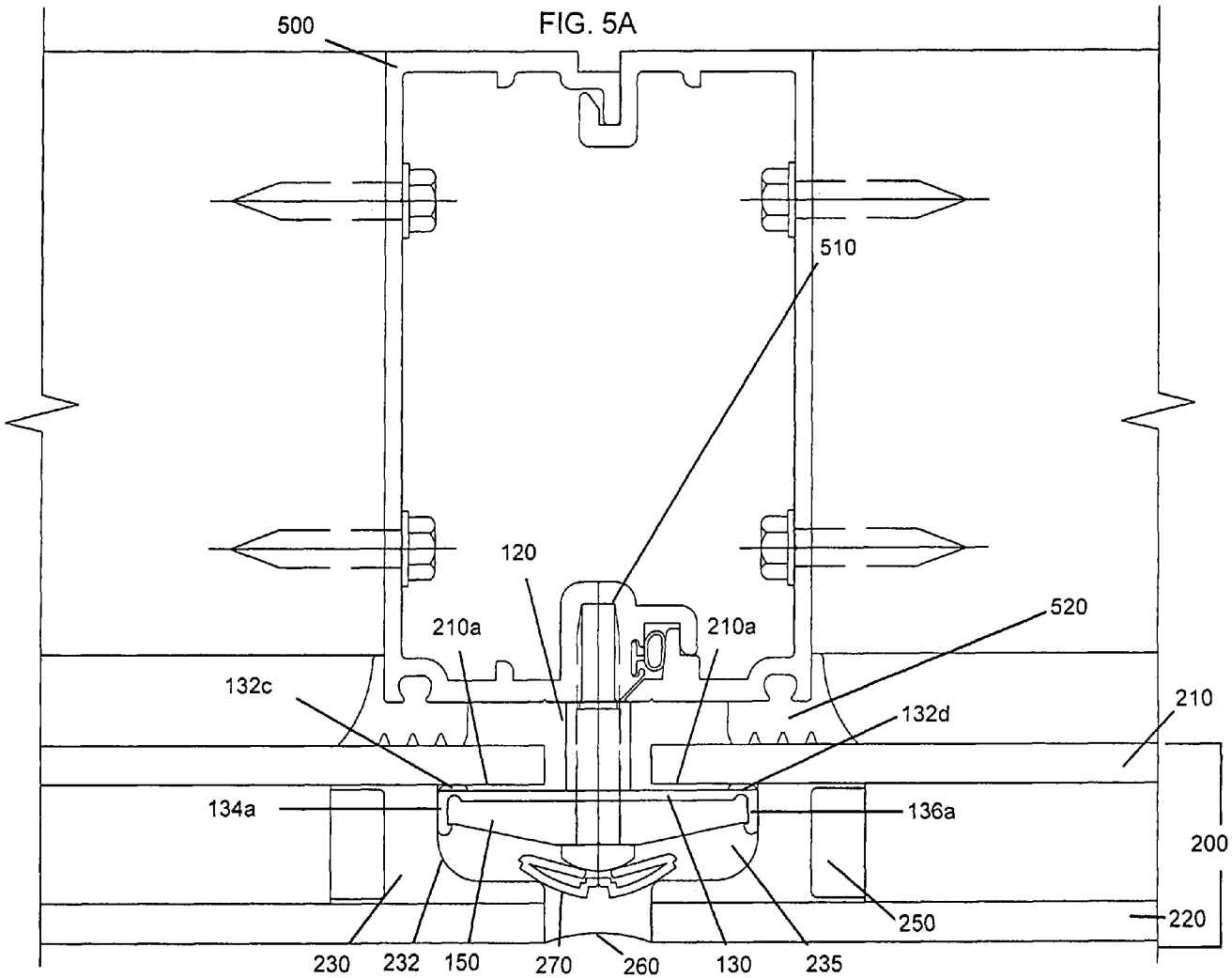
FIG. 5A illustrates a partial horizontal cut-away view of a screw spline toggle glazed curtain wall system according to an embodiment of the present invention, including a vertical mullion, a toggle assembly of the present invention, and an insulating glass unit (IGU)
Figure 5B:
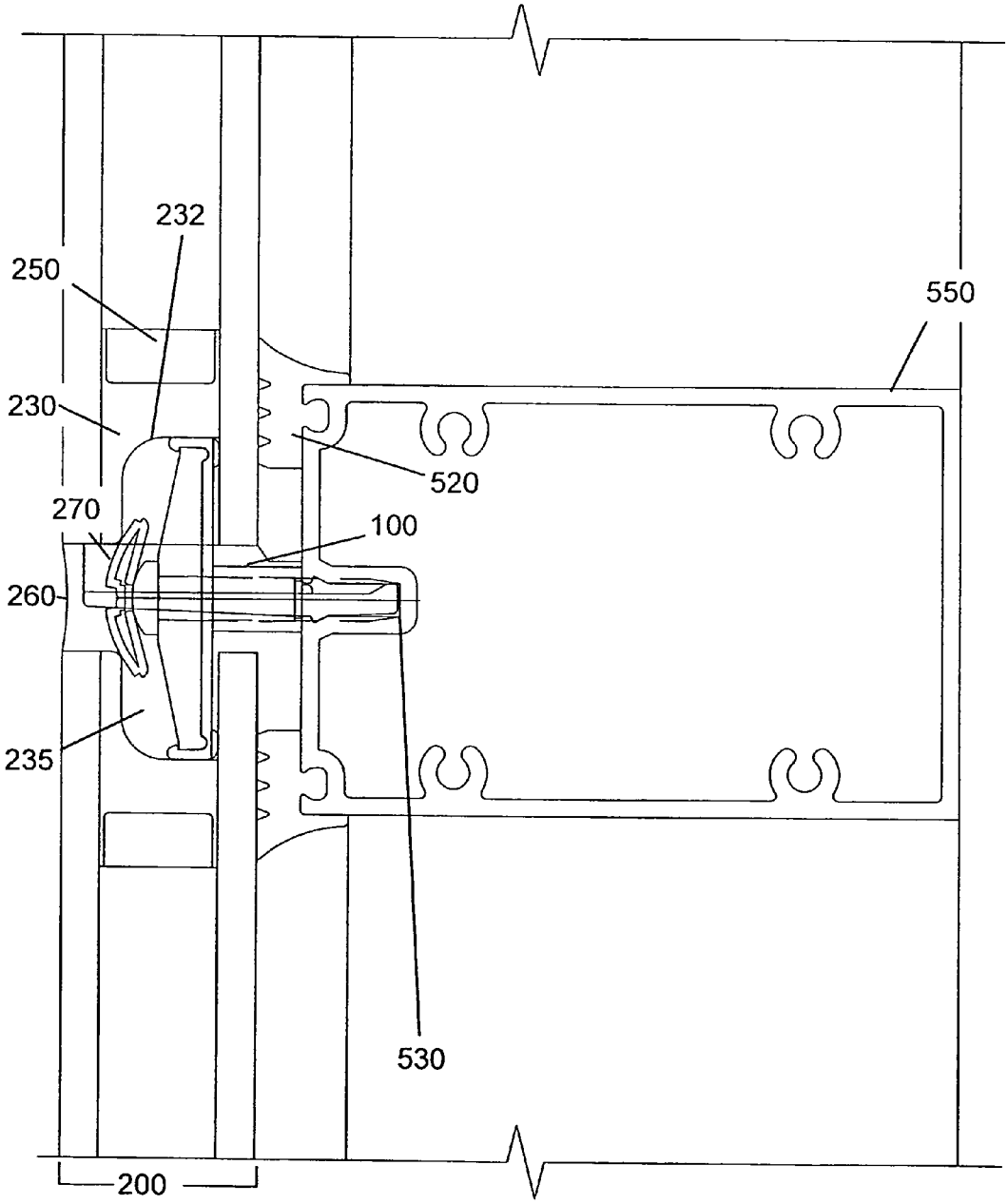
FIG. 5B illustrates a partial vertical cut-away view of a screw spline toggle glazed curtain wall system according to an embodiment of the present invention, including a horizontal transom, a toggle assembly of the present invention, and an insulating glass unit (IGU)

FIGS. 5A and 5B illustrate partial cut-away views of a screw spline toggle glazed curtain wall system according to an embodiment of the present invention. In the embodiment illustrated in FIG. 5A, the curtain wall system includes a vertical mullion 500, a toggle assembly 100 and a plurality of insulating glass units (IGU) 200. In the embodiment illustrated in FIG. 5B, the curtain wall system includes a horizontal mullion or transom 550, a toggle assembly 100 and a plurality of insulating glass units (IGU) 200. Each IGU 200 illustrated in FIGS. 5A and 5B is shown at a 1.125 inch thickness, but it should be understood that the application of a toggle assembly 100 of the present invention is not limited to any specific thickness IGU. In an embodiment, each IGU 200 comprises two panes of glass lites 210, 220 attached to a structural separator spacer 250 with a structural adhesive sealant 230, such as structural silicone adhesive. A void 235 is formed between a continuous edge recess 232 of the structural adhesive 230 and the glass lite 210 that is sufficiently shaped to accommodate one end of the toggle clip 130, as illustrated in FIG. 5A and FIG. 5B. The continuous edge recess 232 of the structural adhesive 230 extends around the entire periphery of each IGU 200. Because the continuous edge recess 232 is present along the entire perimeter of each IGU 200, a toggle assembly 100 of the present invention can be positioned anywhere along the vertical height of the mullion 500 and the horizontal length of the transom 550. The mullion 500 has a channel 510 configured for direct engagement with the fastener 160 of the toggle assembly 100. Similarly, the transom 550 has a channel 530 configured for direct engagement with the fastener 160 of the toggle assembly 100. Air seal gaskets 520 may be positioned between the mullion 500 or transom 550 and each of the IGU 200, which provide a space between each of the glass lite 210 of the respective IGU 200. A silicone weatherseal 260 may be positioned between the adjacent edges of the glass lite 220. In order to avoid three-sided sealant adhesion, a sealant joint backer 270 may be positioned over the fastener 160 and between the glass lites 210 and 220.

In an embodiment, the spacer 120 of the toggle assembly 100 is sufficiently designed to allow the assembly 100 to be installed without excessive point loading on the IGU 200 while applying proper compression on the interior air seal gaskets 520 positioned between the mullion 500 or transom 550 and each of the IGU 200, which may contribute to the ease of the glass installation procedure. In an embodiment, after the toggle assembly 100 has been installed to retain two IGU 200, interaction between various components of the toggle assembly 100 and the two IGU 200 include at least the following: left raised portion 132*c* of the toggle clip 130 directly engages an inner surface 210*a* of the glass lite 210 of a first IGU 200 of the pair, while right raised portion 132*d* of the toggle clip 130 directly engages an inner surface 210*a* of the glass lite 210 of the second IGU 200 of the pair; outer surface 134*a* of the toggle clip 130 directly engages an outer surface of the continuous edge recess 230 of a first IGU 200 of the pair, while outer surface 136*a* of the toggle clip 130 directly engages an outer surface of the continuous edge recess 230 of the second IGU 200 of the pair; and fastener 160 engages the channel 510 of the mullion 500 (FIG. 5A) or the channel 530 of the transom 550 (FIG. 5B). The distance between the two glass lite 210 of the pair of installed IGU 200 is larger than the external diameter of the spacer 120 such that a small amount of space exists between each side of the spacer 120 and the glass lite 210. In an embodiment, the height of the spacer 120 is determined based on the thickness of the glass lite 210 and the proper compression of the interior air seal gaskets 520.

Figure 6:
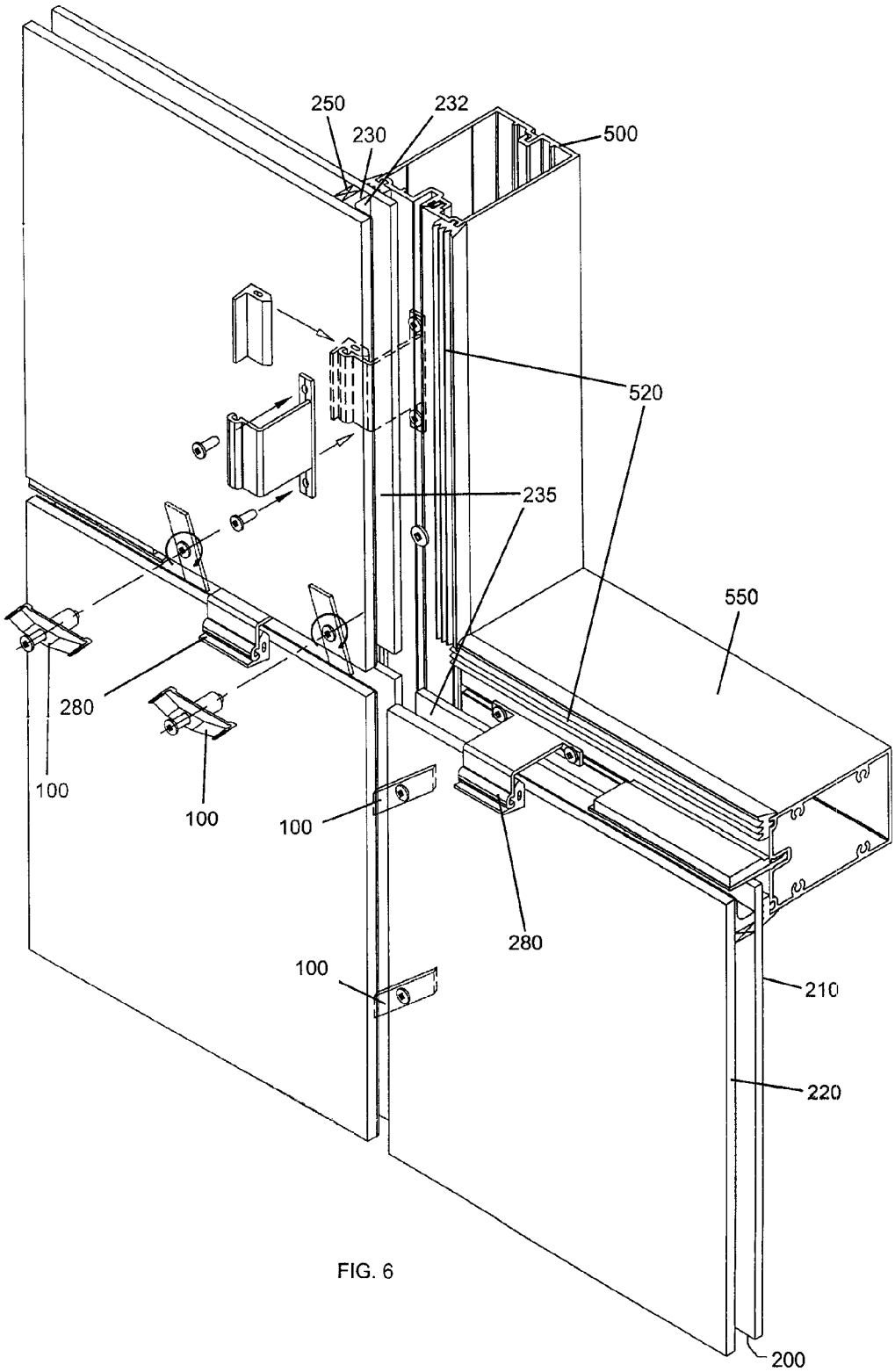
FIG. 6 is a pictorial perspective view of a representative portion of a toggle glazed curtain wall system as viewed from the exterior according to an embodiment of the present invention, showing installation of a plurality of toggle assemblies of the present invention.

FIG. 6 is a pictorial perspective view of a representative portion of a toggle glazed curtain wall system as viewed from the exterior according to an embodiment of the present invention, showing installation of a plurality of toggle assemblies 100 of the present invention. The spacing between the toggle assemblies 100 may vary for a specific application. The insulating glass unit 200 includes the first glass lite 210 and the second glass lite 220 mounted parallel to and spaced from the first glass lite 210 by the separator spacer 250 and having the edge with a continuous recess 230. The glass lites 210 and 220 can be marked as needed for toggle assembly 100 locations. The toggle assembly 100 is installed as illustrated in conjunction with FIGS. 4A and 4B. Pressure may be applied to the face of the glass lites 210 and 220 during toggle assembly 100 installation. The internal diameter of the exit end 167 of the receiving hole 165 is sized so that, when the fastener 160 is positioned through the receiving holes 175 and 165, and the fastener 160 is turned, threads of the fastener 160 grab the circular ridge 125 and automatically rotate the toggle assembly 100 into position, as described above with reference to FIGS. 4A and 4B. After a few toggle assemblies 100 have been applied between the glass lites 210, 220 any temporaries 280 can be removed.

Figure 7:
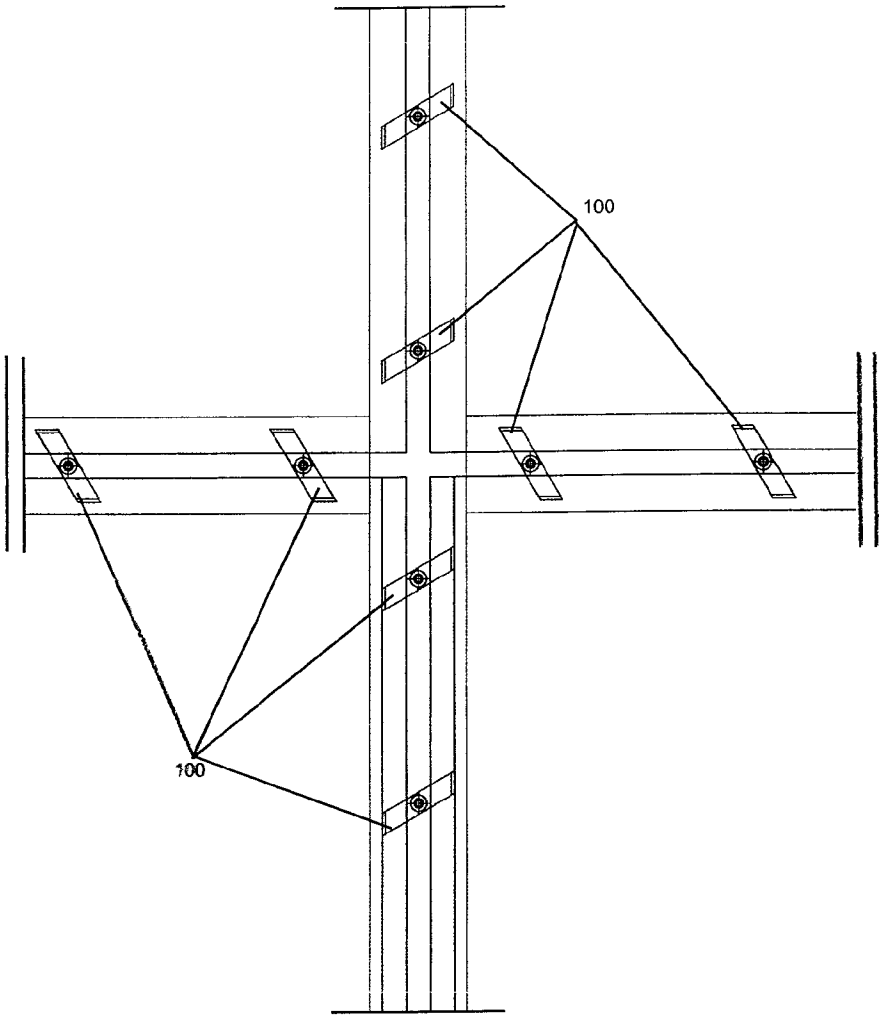
FIG. 7 is a pictorial partial front view of a representative portion of a toggle glazed curtain wall system as viewed from the exterior according to an embodiment of the present invention, showing a plurality of toggle assemblies of the present invention installed.

FIG. 7 is a pictorial front view of a representative portion of a toggle glazed curtain wall system as viewed from the exterior according to an embodiment of the present invention, showing a plurality of toggle assemblies 100 of the present invention installed. The toggle assemblies 100 are configured to provide the mechanical retention necessary to retain the glazing lites to the curtain wall glazing system. As illustrated, a toggle assembly 100 is positioned to retain two glass lites of an insulating glass unit in place on both sides of a mullion. It should be understood that the number of toggle assemblies 100 positioned along the vertical edge and the horizontal edge of the IGU 200 may vary for a specific application.

Figure 8B:
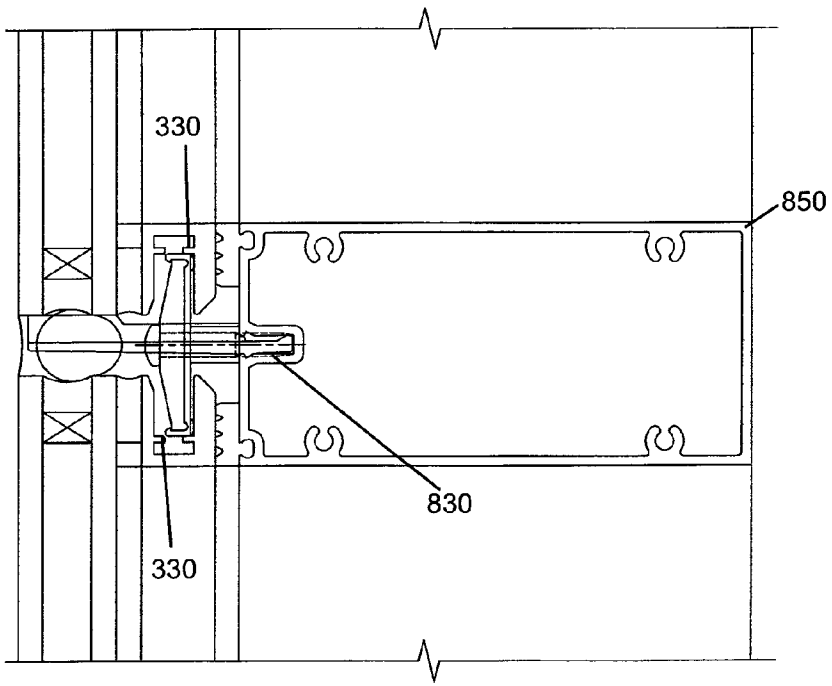
FIG. 8B illustrates a partial vertical cut-away view of a screw spline interface toggle glazed curtain wall system according to an embodiment of the present invention, including a horizontal transom, a toggle assembly of the present invention, and an insulating glass unit (IGU). Structural silicone adhesive is illustrated in this view.
Figure 8A:
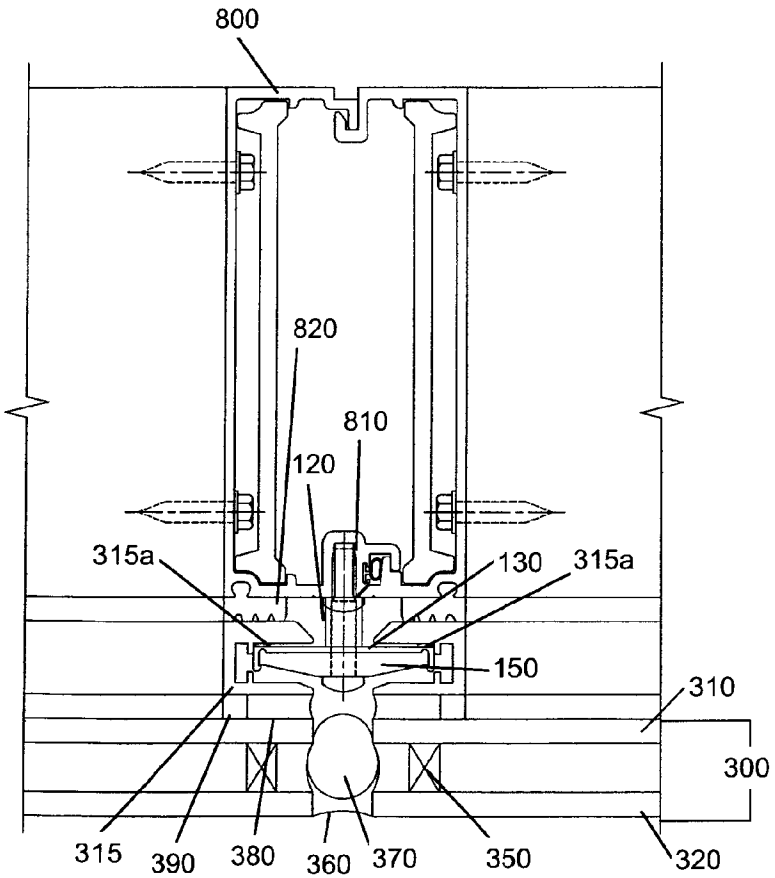
FIG. 8A illustrates a partial horizontal cut-away view of a screw spline interface toggle glazed curtain wall system according to an embodiment of the present invention, including a vertical mullion, a toggle assembly of the present invention, and an insulating glass unit (IGU). Structural silicone adhesive is illustrated in this view.

FIGS. 8A and 8B illustrate partial horizontal cut-away views of a screw spline interface toggle glazed curtain wall system according to an embodiment of the present invention. In the embodiment illustrated in FIG. 8A, the curtain wall system includes a vertical mullion 800, a toggle assembly 100, an interface channel 315, and a plurality of insulating glass units (IGU) 300. In the embodiment illustrated in FIG. 8B, the curtain wall system includes a horizontal mullion or transom 850, a toggle assembly 100, an interface channel 315, and a plurality of insulating glass units (IGU) 300. Each IGU 300 illustrated in FIGS. 8A and 8B is shown at a 1.000 inch thickness, but it should be understood that the application of a toggle assembly 100 of the present invention is not limited to any specific thickness IGU. In an embodiment, each IGU 300 comprise two panes of glass lites 310, 320 attached to a structural spacer 350 with a structural adhesive, such as structural silicone adhesive. Each IGU 300 engages the interface channel 315 with a structural adhesive 380, such as structural silicone adhesive, and a glazing tape 390, such as urethane glazing tape. Each interface channel 315 has a continuous edge recess 330 that is sufficiently shaped to accommodate one end of the toggle clip 130, as illustrated in FIG. 8A and FIG. 8B. In an embodiment, the interface channel 315 is fabricated from an extruded aluminum. The continuous edge recess 330 extends around the entire periphery of each interface channel 315. Because the continuous edge recess 330 is present along the entire perimeter of each interface channel 315, a toggle assembly 100 of the present invention can be positioned anywhere along the vertical height of the mullion 800 and the horizontal length of the transom 850. The mullion 800 has a channel 810 configured for direct engagement with the fastener 160 of the toggle assembly 100. Similarly, the transom 850 has a channel 830 configured for direct engagement with the fastener 160 of the toggle assembly 100. Air seal gaskets 820 may be positioned between the mullion 800 or transom 850 and each of the interface channels 315, which provide a space between each of the interface channels 315. A silicone weatherseal 360 may be positioned between the adjacent edges of the glass lite 320. In order to avoid three-sided sealant adhesion, a backer rod 370 may optionally be applied.

In an embodiment, the spacer 120 of the toggle assembly 100 is sufficiently designed to allow the assembly 100 to be installed without excessive point loading on the IGU 300 while applying proper compression on the interior air seal gaskets 820 positioned between the mullion 800 or transom 850 and each of the IGU 300, which may contribute to the ease of the glass installation procedure. In an embodiment, after the toggle assembly 100 has been installed to retain two IGU 300, interaction between various components of the toggle assembly 100 and the two interface channels 315 include at least the following: left raised portion 132*c* of the toggle clip 130 directly engages an inner surface 315*a* of the first interface channel 315 of the pair, while right raised portion 132*d* of the toggle clip 130 directly engages an inner surface 315*a* of the second interface channel 315 of the pair; outer surface 134*a* of the toggle clip 130 directly engages an outer surface of the continuous edge recess 330 of the first interface channel 315 of the pair, while outer surface 136*a* of the toggle clip 130 directly engages an outer surface of the continuous edge recess 330 of the second interface channel 315 of the pair; and fastener 160 engages the channel 810 of the mullion 800 (FIG. 8A) or the channel 830 of the transom 850 (FIG. 8B). The distance between the two interface channels 315 of the pair is larger than the external diameter of the spacer 120 such that a small amount of space exists between each side of the spacer 120 and the interface channels 315. In an embodiment, the height of the spacer 120 is determined based on the thickness of the glass lite 310 and the proper compression of the interior air seal gaskets 820.

Figure 9B:
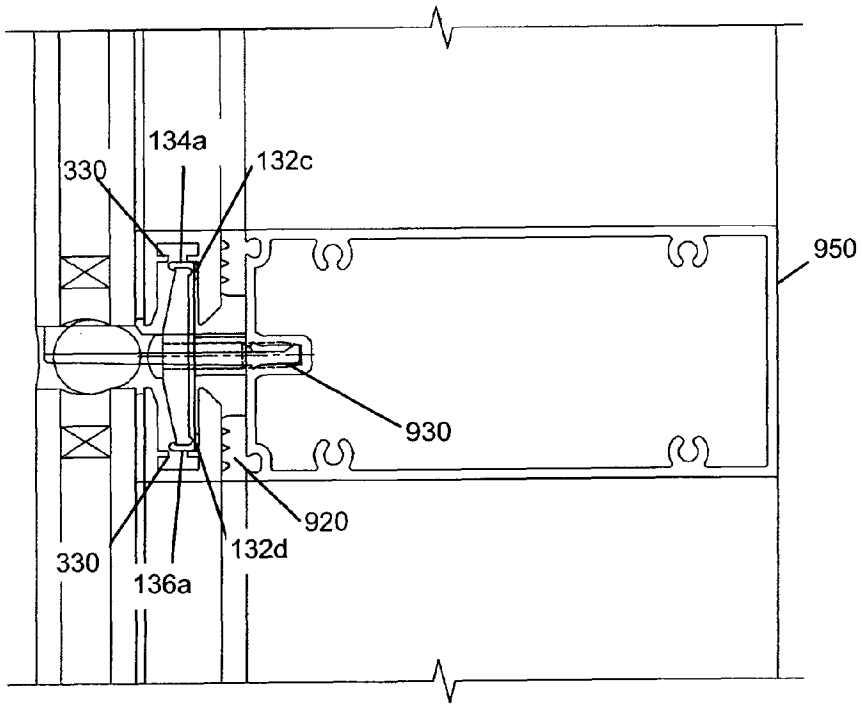
FIG. 9B illustrates a partial vertical cut-away view of a screw spline interface tape toggle glazed curtain wall system according to an embodiment of the present invention, including a horizontal transom, a toggle assembly of the present invention, and an insulating glass unit (IGU). Structural glazing tape is illustrated in this view.
Figure 9A:
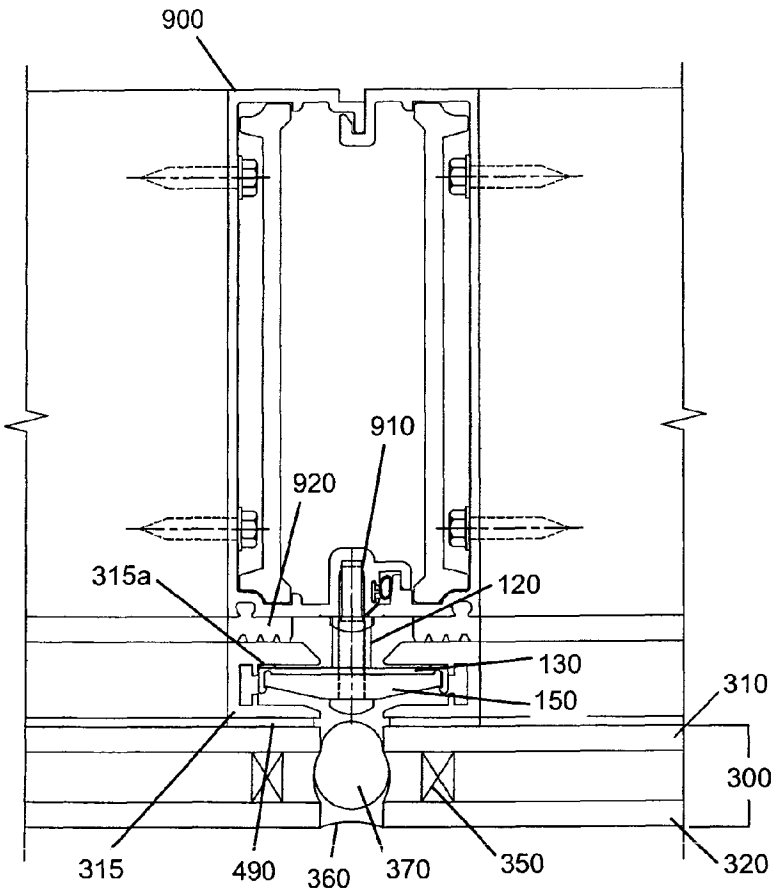
FIG. 9A illustrates a partial horizontal cut-away view of a screw spline interface tape toggle glazed curtain wall system according to an embodiment of the present invention, including a vertical mullion, a toggle assembly of the present invention, and an insulating glass unit (IGU). Structural glazing tape is illustrated in this view.

FIGS. 9A and 9B illustrate partial horizontal cut-away views of a screw spline interface tape toggle glazed curtain wall system according to an embodiment of the present invention. In the embodiment illustrated in FIG. 9A, the curtain wall system includes a vertical mullion 900, a toggle assembly 100, an interface channel 315, and a plurality of insulating glass units (IGU) 300. In the embodiment illustrated in FIG. 9B, the curtain wall system includes a horizontal mullion or transom 950, a toggle assembly 100, an interface channel 315, and a plurality of insulating glass units (IGU) 300. Each IGU 300 illustrated in FIGS. 9A and 9B is shown at a 1.000 inch thickness, but it should be understood that the application of a toggle assembly 100 of the present invention is not limited to any specific thickness IGU. In an embodiment, each IGU 300 comprise two panes of glass lites 310, 320 attached to a structural spacer 350 with a structural adhesive, such as structural silicone adhesive. Each IGU 300 engages the interface channel 315 with a structural glazing tape 490, such as acrylic glazing tape. Each interface channel 315 has a continuous edge recess 330 that is sufficiently shaped to accommodate one end of the toggle clip 130, as illustrated in FIG. 9A and FIG. 9B. The continuous edge recess 330 extends around the entire periphery of each interface channel 315. Because the continuous edge recess 330 is present along the entire perimeter of each interface channel 315, a toggle assembly 100 of the present invention can be positioned anywhere along the vertical height of the mullion 900 and the horizontal length of the transom 950. The mullion 900 has a channel 910 configured for direct engagement with the fastener 160 of the toggle assembly 100. Similarly, the transom 950 has a channel 930 configured for direct engagement with the fastener 160 of the toggle assembly 100. Air seal gaskets 920 may be positioned between the mullion 900 or transom 950 and each of the interface channels 315, which provide a space between each of the interface channels 315. A silicone weatherseal 360 may be positioned between the adjacent edges of the glass lite 320. In order to avoid three-sided sealant adhesion, a backer rod 370 may optionally be applied.

In an embodiment, the spacer 120 of the toggle assembly 100 is sufficiently designed to allow the assembly 100 to be installed without excessive point loading on the IGU 300 while applying proper compression on the interior air seal gaskets 920 positioned between the mullion 900 or transom 950 and each of the IGU 300, which may contribute to the ease of the glass installation procedure. In an embodiment, after the toggle assembly 100 has been installed to retain two IGU 300, interaction between various components of the toggle assembly 100 and the two interface channels 315 include at least the following: left raised portion 132*c* of the toggle clip 130 directly engages an inner surface 315*a* of the first interface channel 315 of the pair, while right raised portion 132*d* of the toggle clip 130 directly engages an inner surface 315*a* of the second interface channel 315 of the pair; outer surface 134*a* of the toggle clip 130 directly engages an outer surface of the continuous edge recess 330 of the first interface channel 315 of the pair, while outer surface 136*a* of the toggle clip 130 directly engages an outer surface of the continuous edge recess 330 of the second interface channel 315 of the pair; and fastener 160 engages the channel 910 of the mullion 900 (FIG. 9A) or the channel 930 of the transom 950 (FIG. 9B). The distance between the two interface channels 315 of the pair is larger than the external diameter of the spacer 120 such that a small amount of space exists between each side of the spacer 120 and the interface channels 315. In an embodiment, the height of the spacer 120 is determined based on the thickness of the glass lite 310 and the proper compression of the interior air seal gaskets 920.

In an embodiment, a toggle assembly of the present invention includes a toggle component comprising a clip and a spacer, wherein the clip comprises a base, a left face, and a right face, wherein the base has an upper surface engaging the spacer and a lower surface, wherein the left face comprises an outer surface and an inner surface, wherein the right face comprises an outer surface and an inner surface, wherein a left-side track forms at a junction between the lower surface of the base and the inner surface of the left face, wherein a right-side track forms at a junction between the lower surface of the base and the inner surface of the right face, wherein the left face terminates in a left engagement leg, wherein the right face terminates in a right engagement leg, and wherein the spacer is substantially shaped as a hollow cylinder having a first end engaging the upper surface of the base and a second end, wherein the spacer has a first internal radius at the first end that is larger than a second internal radius at the second end, and wherein an internal circular ridge is created at a junction between the first internal radius and the second internal radius; and a support reinforcement bar, wherein the support reinforcement bar is sized and dimensioned to fit within a space created between the lower surface of the base, the inner surface of the left face, and the inner surface of the right face, wherein the support reinforcement bar comprises a left lip that engages with the left-side track of the toggle component and a right lip that engages with the right-side track of the toggle component, and wherein the engagement leg of the left face and the engagement leg of the right face are sufficiently designed to maintain the support reinforcement bar within the clip of the toggle component. In an embodiment, the upper surface of the base has a left end terminating in a left raised portion and a right end terminating in a right raised portion, wherein the left face descends from the left raised portion of the base, and wherein the right face descends from the right raised portion of the base. In an embodiment, a thickness of a wall of the spacer increases longitudinally from the first end to the second end. In an embodiment, the toggle component includes a receiving hole configured to receive a fastener, wherein the receiving hole comprises an entry end at the base and an exit end at the second end of the spacer, and wherein the support reinforcement bar includes a receiving hole configured to receive a fastener. In an embodiment, an internal diameter of the entry end of the receiving hole is larger than an internal diameter of the exit end of the receiving hole. In an embodiment, the internal diameter of the entry end of the receiving hole is between about 0.250 inches and about 0.260 inches. In an embodiment, the internal diameter of the exit end of the receiving hole is between about 0.210 inches and about 0.220 inches. In an embodiment, an internal diameter of the receiving hole is substantially the same the internal diameter of the entry end of the receiving hole. In an embodiment, the internal diameter of the exit end of the receiving hole is sized so that, when a fastener is positioned through the receiving hole and the receiving hole, and the fastener is turned, threads of the fastener grab the circular ridge and rotate the toggle assembly.

In an embodiment, a pair of insulating glass units for a building includes at least one toggle assembly of the present invention, the toggle assembly being sufficiently designed to retain or fix the glass lites of an insulating glass unit in place on both sides of a mullion (i.e., support two glass lites simultaneously) reducing the number of toggle assemblies required for a given application as compared to conventional retaining components.

In an embodiment, a toggle glazed curtain wall system includes at least one toggle assembly of the present invention, the toggle assembly being sufficiently designed to retain or fix the glass lites of an insulating glass unit in place on both sides of a mullion (i.e., support two glass lites simultaneously) reducing the number of toggle assemblies required for a given application as compared to conventional retaining components.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A toggle assembly comprising:

a toggle component comprising a clip and a spacer;

wherein the clip comprises a base, a left face, and a right face, wherein the base has an upper surface engaging the spacer and a lower surface, wherein the left face comprises an outer surface and an inner surface, wherein the right face comprises an outer surface and an inner surface, wherein a left-side track forms at a junction between the lower surface of the base and the inner surface of the left face, wherein a right-side track forms at a junction between the lower surface of the base and the inner surface of the right face, wherein the left face terminates in a left engagement leg, wherein the right face terminates in a right engagement leg, and wherein the spacer is substantially shaped as a hollow cylinder having a first end engaging the upper surface of the base and a second end, wherein the spacer has a first internal radius at the first end that is larger than a second internal radius at the second end, and wherein an internal circular ridge is created at a junction between the first internal radius and the second internal radius; and a support reinforcement bar, wherein the support reinforcement bar is sized and dimensioned to fit within a space created between the lower surface of the base, the inner surface of the left face, and the inner surface of the right face, wherein the support reinforcement bar comprises a left lip that engages with the left-side track of the toggle component and a right lip that engages with the right-side track of the toggle component, and wherein the engagement leg of the left face and the engagement leg of the right face are sufficiently designed to maintain the support reinforcement bar within the clip of the toggle component.

2. The toggle assembly of claim 1 wherein the toggle component is manufactured from a polymer material.

3. The toggle assembly of claim 2 wherein the toggle component is manufactured from acrylonitrile butadiene styrene (ABS).

4. The toggle assembly of claim 1 wherein the base is shaped like a parallelogram having two angles of approximately 60° and two angles of approximately 120°.

5. The toggle assembly of claim 1 wherein the support reinforcement bar is manufactured from a corrosion-resistant material selected from the group consisting of metals, ceramics and polymers.

6. The toggle assembly of claim 1 wherein the support reinforcement bar is manufactured from an aluminum alloy material.

7. The toggle assembly of claim 1, wherein the upper surface of the base has a left end terminating in a left raised portion and a right end terminating in a right raised portion, wherein the left face descends from the left raised portion of the base, and wherein the right face descends from the right raised portion of the base.

8. The toggle assembly of claim 1, wherein the toggle component includes a receiving hole configured to receive a fastener, wherein the receiving hole comprises an entry end at the base and an exit end at the second end of the spacer, and wherein the support reinforcement bar includes a receiving hole configured to receive a fastener.

9. The toggle assembly of claim 8 wherein an internal diameter of the entry end of the receiving hole is larger than an internal diameter of the exit end of the receiving hole.

10. The toggle assembly of claim 9 wherein the internal diameter of the entry end of the receiving hole is between about 0.250 inches and about 0.260 inches.

11. The toggle assembly of claim 9 wherein the internal diameter of the exit end of the receiving hole is between about 0.210 inches and about 0.220 inches.

12. The toggle assembly of claim 9 wherein an internal diameter of the receiving hole is substantially the same the internal diameter of the entry end of the receiving hole.

13. The toggle assembly of claim 9 wherein the internal diameter of the exit end of the receiving hole is sized so that, when a fastener is positioned through the receiving hole and the receiving hole, and the fastener is turned, threads of the fastener grab the circular ridge and rotate the toggle assembly.

14. A curtain wall glazing system comprising the toggle assembly of claim 1.

* * * * *